US006302091B1

(12) United States Patent
Iida

(10) Patent No.: US 6,302,091 B1
(45) Date of Patent: Oct. 16, 2001

(54) AIR-FUEL RATIO FEEDBACK CONTROL FOR ENGINES HAVING FEEDBACK DELAY TIME COMPENSATION

(75) Inventor: Hisashi Iida, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/523,291

(22) Filed: Mar. 10, 2000

(30) Foreign Application Priority Data

Apr. 28, 1999 (JP) ..... 11-121617

(51) Int. Cl.[7] ..... F02B 23/00
(52) U.S. Cl. ..... 123/685; 123/681
(58) Field of Search ..... 123/679, 681, 123/682, 685, 686

(56) References Cited

U.S. PATENT DOCUMENTS

| | | | | |
|---|---|---|---|---|
| 4,586,478 | | 5/1986 | Nogami et al. . | |
| 5,347,974 | * | 9/1994 | Togai et al. | 123/682 |
| 5,553,593 | * | 9/1996 | Schnaibel et al. | 123/682 |
| 5,626,122 | * | 5/1997 | Azuma | 123/685 |
| 5,899,192 | * | 5/1999 | Tsutsumi et al. | 123/681 |
| 5,915,359 | * | 6/1999 | Meyer et al. | 123/685 |
| 5,937,798 | * | 8/1999 | Cheng et al. | 123/681 |
| 5,970,966 | * | 10/1999 | Sato | 123/681 |
| 5,983,874 | * | 11/1999 | Suzuki et al. | 123/682 |

FOREIGN PATENT DOCUMENTS 7-26572 3/1995 (JP) .

* cited by examiner

*Primary Examiner*—John Kwon
(74) *Attorney, Agent, or Firm*—Nixon & Vanderhye P.C.

(57) ABSTRACT

In an air-fuel ratio feedback control system for engines, a feedback correction amount is calculated in response to an air-fuel ratio detected at an engine exhaust side to effect an air-fuel ratio feedback control even during an engine warm-up period. A delay time compensation amount is calculated from two basic fuel injection amounts calculated presently and previously. The previous fuel injection amount is calculated the delay time before the present fuel injection amount. The feedback correction amount is corrected with the delay time compensation amount. When the engine undergoes a transient operation condition such as acceleration or deceleration, the present fuel injection amount is corrected with the corrected feedback correction amount. When the basic fuel injection amount changes rapidly due to acceleration, the delay time compensation amount is decreased responsively and the corrected feedback correction amount is increased so that the present fuel injection amount is not reduced too much.

13 Claims, 7 Drawing Sheets

START
301
DURING F/B CONTROL ?
NO
YES
303
READ BASIC F/B AMOUNT FAFCAL
304
READ DELAY COMPENSATION AMOUNT FAFFIX
305
FAFFIX<0.95? (ACCELERATION?)
NO
YES
306
CORRECT LOWER GUARD kFAFL'=1.0-(1.0-kFAFL)×FAFFIX
302
FAF = 1.0
312
FAFCAL≧kFAFL? (NORMAL LOWER GUARD)
NO
YES
313
FAF = kFAFL
307
FAFCAL≧kFAFL'? (CORRECTED LOWER GUARD)
NO
YES
308
FAF = kFAFL'
309
FAFCAL≦kFAFH? (UPPER GUARD)
NO
YES
311
FAF = FAFCAL
310
FAF = kFAFH
RETURN

AIR-FUEL RATIO FEEDBACK CONTROL FOR ENGINES HAVING FEEDBACK DELAY TIME COMPENSATION

CROSS REFERENCE TO RELATED APPLICATION

This application relates to and incorporates herein by reference Japanese Patent Application No. 11-121617 filed on Apr. 28, 1999.

BACKGROUND OF THE INVENTION

This invention relates to an air-fuel ratio feedback control system and method for internal combustion engines which compensates for a response delay of air-fuel ratio detection at the engine exhaust side relative to changes in fuel injection at the engine intake side.

In recent electronically-controlled internal combustion engines, the amount of fuel supplied or injected into the engine is feedback-controlled in response to outputs of an oxygen sensor or an air-fuel ratio sensor disposed in the engine exhaust pipe so that the air-fuel ratio is regulated to a target air-fuel ratio to increase the exhaust purification efficiency of a three-way catalyst disposed in the engine exhaust pipe. The accuracy in the feedback control is rather lessened during transient engine conditions such as the engine acceleration or deceleration in which the amount of fuel rapidly changes, if the feedback control is effected during such a period in the similar manner as in the normal engine operation conditions.

It is to be noted that a part of fuel injected from fuel injectors sticks to intake port inner walls or intake valves of an engine and thereafter gradually evaporates and enters into cylinders causing a fuel supply transport time delay. Further, other time delays are caused, because the exhaust gas travels from the engine to the position of an oxygen sensor and the oxygen sensor has response time to detect the oxygen concentration in the exhaust gas.

Thus, the feedback control system has the fuel supply transport time delay and the air-fuel ratio detection time delay, from changes in the fuel injection amount at the engine intake side to the air-fuel ratio detection at the engine exhaust side. Those delays may result in a time period which corresponds to four to six rotations of the engine crankshaft.

The above delays cause a time delay in the feedback correction amount calculated based on the detected air-fuel ratio. The feedback correction amount changes with a time delay, if the amount of fuel to be injected is calculated in response to the feedback correction amount calculated based on the past fuel injection. That is, the feedback control does not follow quickly and lessens the accuracy in the feedback control, particularly when the fuel injection amount changes rapidly due to changes in the engine operation conditions.

It is therefore proposed in U.S. Pat. No. 4,586,478 (JP-A-58-27847) to stop the feedback control during the engine transient conditions. It is further proposed in JP-B1-7-26572 to stop or minimize the feedback control for a predetermined period when the engine transient condition is a rapid acceleration or deceleration, while effecting the normal feedback control when the engine transient condition is a slow acceleration or deceleration. The rapid acceleration or deceleration is defined as an acceleration or deceleration occurring immediately after the previous engine acceleration or deceleration, and the slow acceleration or deceleration is defined as an acceleration or deceleration occurring from the normal engine conditions. However, those proposed feedback controls are not satisfactory to compensate for the air-fuel ratio detection time delay.

SUMMARY OF THE INVENTION

It is therefore an object of the present invention to provide an air-fuel ratio feedback control system which compensates for delays in fuel supply at an engine intake side and air-fuel ratio detection at an engine exhaust side.

According to the present invention, a feedback correction amount is calculated in response to an air-fuel ratio detected at an engine exhaust side to effect an air-fuel ratio feedback control even during an engine warm-up period. A delay time compensation amount is calculated from two basic fuel injection amounts calculated presently and previously. The previous fuel injection amount is calculated the delay time before the present fuel injection amount. The feedback correction amount is corrected with the delay time compensation amount. When the engine undergoes a transient operation condition such as acceleration or deceleration, the present fuel injection amount is corrected with the corrected feedback correction amount. When the basic fuel injection amount changes rapidly due to acceleration, the delay time compensation amount is decreased responsively and the corrected feedback correction amount is increased to compensate for the feedback delay time.

The delay compensation amount may alternatively be used to correct upper and lower guard values provided for limiting the feedback correction amount.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
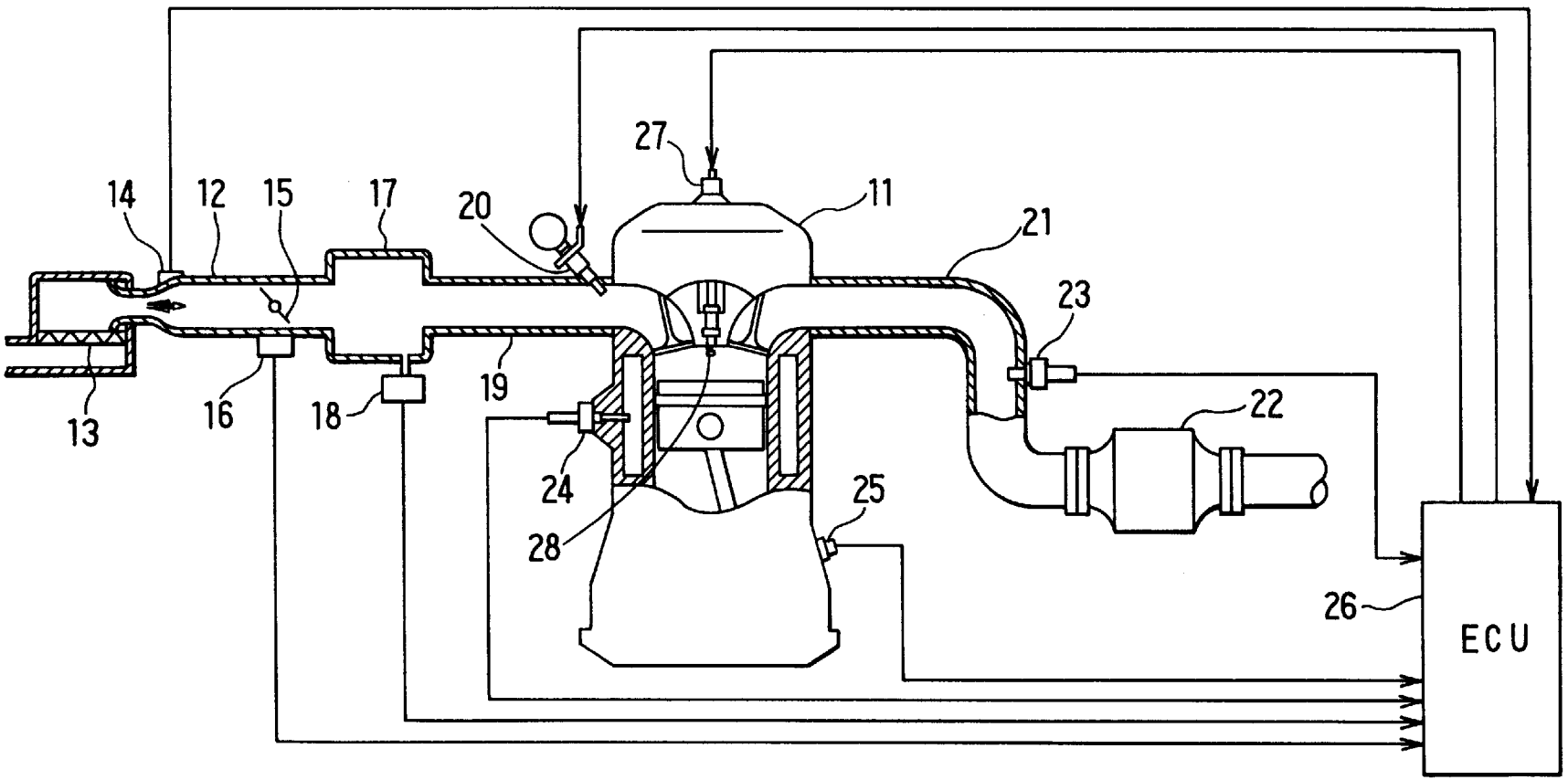
FIG. 1 is a schematic view showing an air-fuel ratio feedback control system according to the present invention.

Referring first to FIG. 1, an internal combustion engine 11 has an intake pipe 12 at an engine intake side. An air cleaner 13 is disposed at the most upstream side of the intake pipe 12, and an air flow sensor 14 is mounted downstream the air cleaner 13 for detecting the amount of air GA supplied to the engine 11. A throttle valve 15 and a throttle sensor 16 for detecting a throttle opening angle TA are disposed downstream the air flow sensor 14. The intake pipe 12 has a surge tank 17 to which a pressure sensor 18 is mounted for detecting the intake air pressure. In take manifolds 19 are connected to the surge tank 17 for leading the intake air to respective cylinders of the engine 11. Fuel injectors 20 are mounted on the intake manifolds 19 to inject fuel into the intake manifolds 19, respectively.

The engine 11 has an exhaust pipe 21 at an engine exhaust side. A catalytic converter 22 including therein a three-way catalyst for purifying exhaust components (CO, HC, $NO_x$, etc.) is disposed in the exhaust pipe 21. An oxygen sensor 23 is disposed upstream the catalytic converter 22 to detect richness/leanness of air-fuel mixture from the oxygen concentration in the exhaust gas. The oxygen sensor 23 may be an electromotive force voltage output type or a limit current output type both of which are well known in the art.

A coolant temperature sensor 24 for detecting an engine coolant temperature and a crank angle sensor 25 for detecting a crankshaft rotation are mounted on the engine 11. The above sensors 14, 16 18, 23, 24 and 25 are connected to an electronic control unit (ECU) 26. The ECU 26 is comprised of a microcomputer which is programmed to control the fuel injection amount and timing of the fuel injectors 20 based on engine operation conditions detected by the sensors. The microcomputer is further programmed to control ignition coils and plugs 27 mounted on the engine 11.

Specifically, the microcomputer of the ECU 26 is programmed to feedback-control the fuel injection amount based on a feedback correction amount FAF calculated in response to the output of the oxygen sensor 23. The fuel injection amount is calculated in such a manner that a basic fuel injection amount TP is calculated first from engine load parameters such as the intake air amount GA or pressure PM and the engine rotation speed, and then corrected with various other engine parameters such as the coolant temperature THW and the feedback correction amount FAF.

The feedback correction amount FAF changes with a time delay relative to changes in the amount of injected fuel due to a fuel supply transport delay at the engine intake side and an air-fuel ratio detection delay at the engine exhaust side. The time delay is large during an engine warm-up period (low temperature starting period), because the injected fuel sticks to the intake ports more during that period than during the normal engine operation conditions. The time delay is also large when the engine operation condition changes rapidly for acceleration or deceleration, because the fuel injection amount changes largely in the transient engine conditions.

Figure 3:
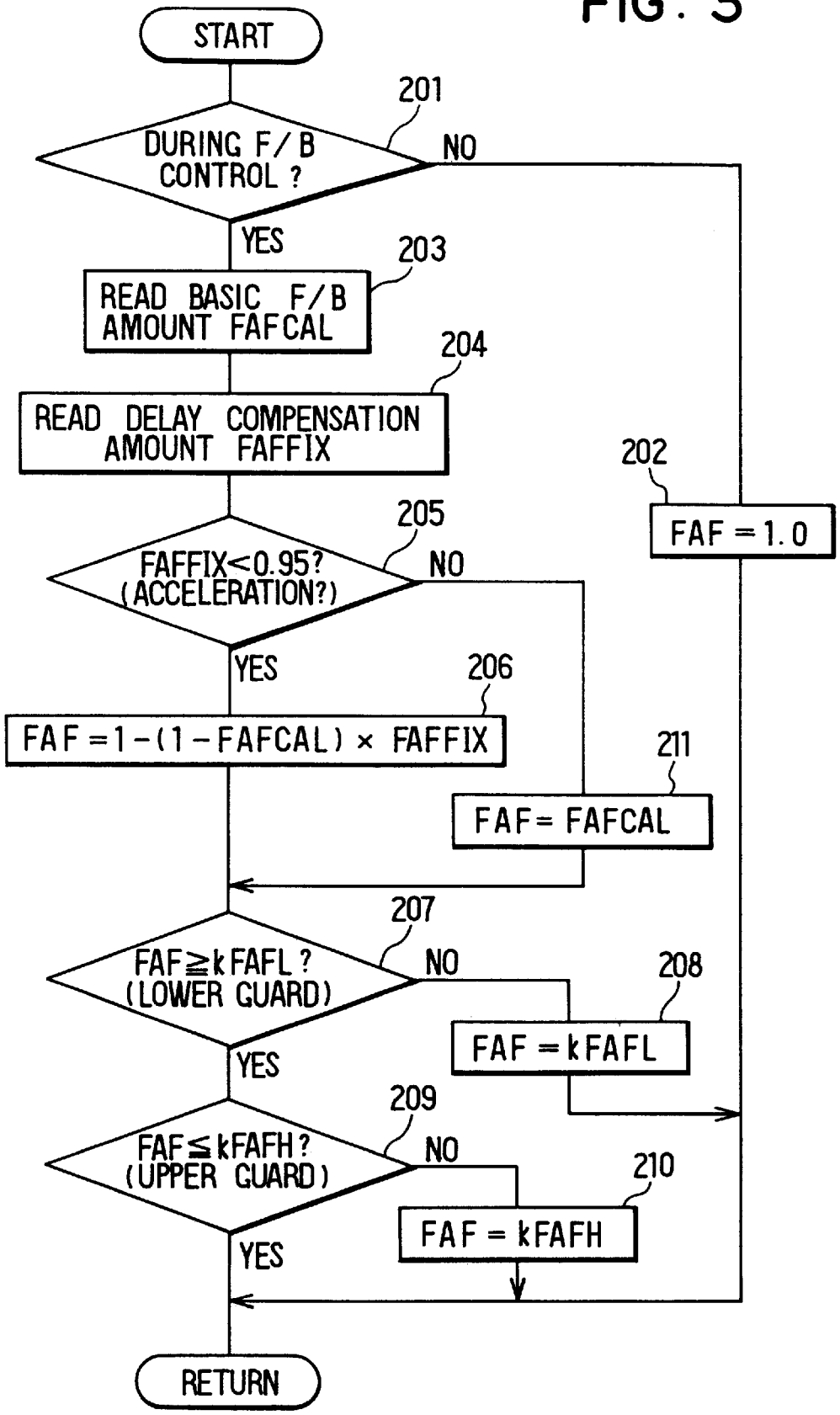
FIG. 3 is a flow diagram showing a feedback correction amount compensation program executed in the first embodiment of the present invention.

The microcomputer of the ECU 26 is therefore programmed to calculate a delay compensation amount FAFFIX in correspondence with the fuel supply transport delay and the air-fuel ratio detection delay during the engine warm-up period according to a first embodiment shown in FIG. 3. Further, it is programmed to correct the feedback correction amount FAFFIX based on the calculated delay compensation amount upon engine acceleration during the engine warm-up period.

Referring specifically to FIG. 3, the program is initiated at every fuel injection. It is checked at steps 101, 102, 103 and 104 whether the engine is in a predetermined warm-up condition. That is, it is checked whether an air-fuel ratio feedback control is being effected (step 101), whether an engine-start coolant temperature THWST is below 40° C. (step 102), whether a present coolant temperature THW is within a predetermined temperature range of −40° C. to 60° C. (step 103), and whether a time elapsed from the engine starting TST is less than 120 seconds (step 104).

If any one of the check results at steps 101 to 104 is NO indicating that the engine 11 is not in the warm-up condition, the delay compensation amount FAFFIX is set to a constant value (1.0) at step 105. In this instance, a basic feedback correction amount FAFCAL is not corrected as described later, because the time delay will be minimal.

If all the check results at steps 101 to 104 are YES indicating that the engine 11 is in the warm-up condition, the delay compensation amount FAFFIX is calculated as follows using a basic fuel injection amount TP(n) at present and a past basic fuel injection amount TP(n−k) which was calculated a predetermined number of injection times (k-times) before the present injection.

$$FAFFIX=TP(n-k)/TP(n)$$

Here, the predetermined number (k) of fuel injections is set to the number of injections which corresponds to a sum of the fuel supply transfer delay at the engine intake side and the air-fuel ratio detection delay at the engine exhaust side. The fuel transport delay is caused primarily by fuel which sticks to the intake port inner walls and the like (fuel wetting), and the detection delay is caused primarily by the exhaust gas travel and the response characteristics of the oxygen sensor 23. The predetermined number (k) may be determined to a fixed value determined empirically or to a value which varies with various parameters (coolant temperature THW, engine rotation speed NE, intake air amount GA, intake air pressure PM, throttle opening angle TA, etc.) which affects the fuel transport delay and the detection delay.

Referring next to FIG. 3, the program is also initiated at every fuel injection. It is checked at step 201 whether the feedback control is being effected. If the check result is NO, a feedback correction amount FAF is set to a constant value (1.0) at step 202. The FAF is a correction value which is multiplied to the calculated basic fuel injection amount Tp as is known well. Therefore, FAF=1.0 does not change the fuel injection amount even if multiplied to the calculated basic fuel injection amount Tp.

If the check result at step 201 is YES, on the other hand, the basic feedback correction amount FAFCAL and the delay compensation amount FAFFIX are read in or retrieved at steps 203 and 204, respectively. The basic feedback correction amount FAFCAL is the feedback correction amount which has been calculated in response to the output of the oxygen sensor 23 in an airfuel ratio control program (not shown) in the known manner before being corrected with the delay compensation amount FAFFIX.

It is checked at step 205 whether the delay compensation amount FAFFIX (=TP(n−k)/Tp(n)) is less than an acceleration detection value (for instance, 0.95) to check whether the engine 11 is in the acceleration condition. If FAFFIX is less than 0.95, the engine 11 is determined to be in the acceleration condition, because it means that the change in the basic fuel injection amounts (TP(n)−TP(n−k)) is increasing. If the check result at step 205 is YES indicating the engine acceleration, the final feedback correction amount FAF is calculated at step 206 as follows.

$$FAF=1-(1-FAFCAL)\times FAFFIX$$

If the check result at step 205 is NO indicating the normal engine conditions, the feedback correction amount is set to the basic feedback correction amount FAFCAL at step 211.

It is then checked at step 207 whether the feedback correction amount FAF is equal to or larger than a lower guard or limit value kFAFL (for instance, 0.75). If the check result is NO indicating that FAF is smaller than kFAFL, the feedback correction amount FAF is fixed to the lower guard value kFAFL at step 208.

If the check result at step 207 is YES, on the other hand, it is further checked at step 209 whether the feedback correction amount FAF is equal to or lower than an upper guard or limit value kFAFH (for instance, 1.25). If the check result is NO indicating that FAF is larger than kFAFH, the feedback correction amount FAF is fixed to the upper guard value kFAFH at step 210.

If both check results at steps 207 and 209 are YES indicating that FAF is between kFAFL and kFAFH, the feedback correction amount determined at step 206 or 211 is not limited but is used as it is to correct the basic fuel injection amount TP. It is to be noted that the guard values kFAFL and kFAFH are set to limit the feedback correction amount FAF to change only between the guard values kFAFL and kFAFH.

Figure 4A:
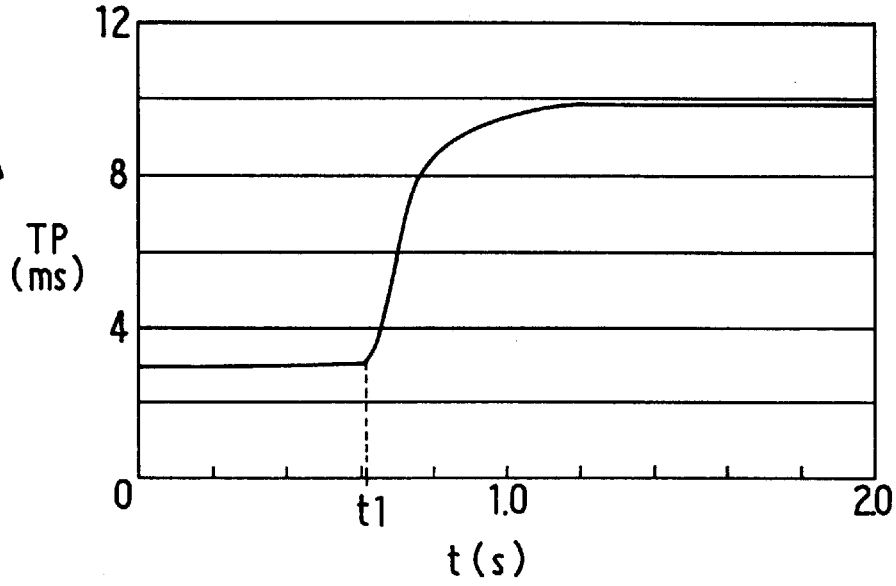
FIGS. 4A and 4B are timing diagrams showing an operation of an air-fuel ratio feedback control system different from the first embodiment.
Figure 4B:
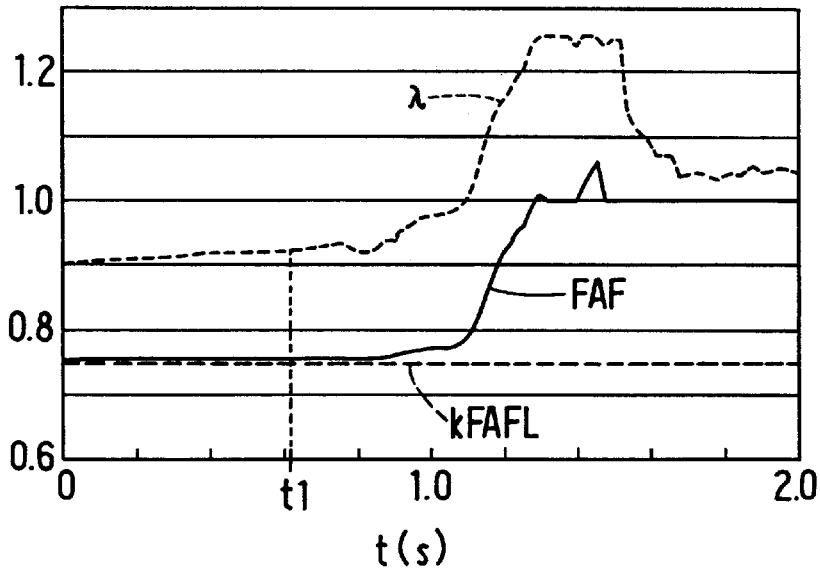
Figure 5A:
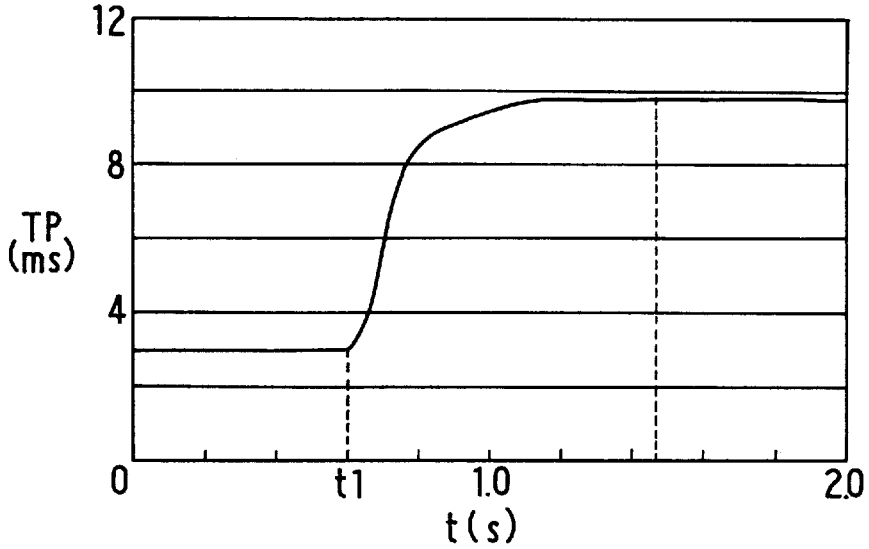
FIGS. 5A, 5B and 5C are timing diagrams showing an operation of the first embodiment shown in FIGS. 2 and 3.
Figure 5B:
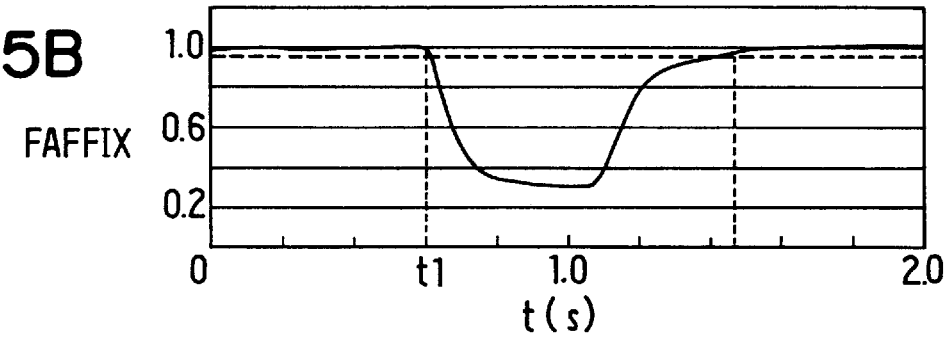
Figure 5C:
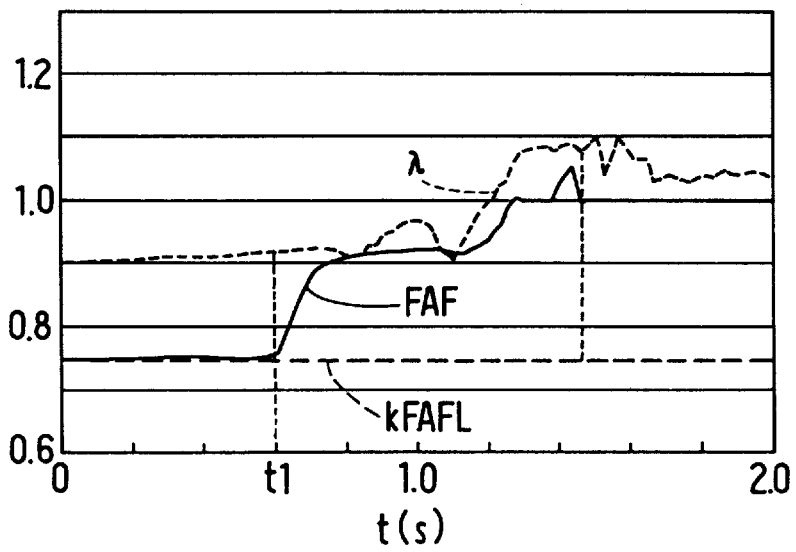

The operation of the first embodiment (FIGS. 2 and 3) is shown in FIGS. 5A, 5B and 5C in comparison with the operation of another type shown in FIGS. 4A and 4B which has no delay compensation function. In FIGS. 4A, 4B, 5A, 5B and 5C, changes of the basic fuel injection amount TP, the delay compensation amount FAFFIX, the feedback correction amount FAF and the air excess number λ (air-fuel ratio) are shown, assuming that the engine 11 is accelerated at time t1 from an engine-decelerated and fuel-rich (λ<1) condition (that is, the feedback correction amount FAF is limited to the lower guard value kFAFL) during the engine warm-up period.

As shown in FIGS. 4A and 4B, the air-fuel ratio (λ) detected at the engine exhaust side changes with a certain time delay relative to the increasing change in the basic fuel injection amount TP. The feedback correction amount FAF calculated in response to the detected air-fuel ratio thus also has the time delay relative to the change in the fuel injection amount TP. During this delay time, the fuel injection amount TP calculated presently (after time t1) to increase for acceleration is continued to be corrected with a small feedback correction amount FAF determined before time t1. That is, the amount of fuel actually injected into the engine 11 is reduced more than the presently calculated fuel injection amount TP, resulting in too fuel-lean air-fuel ratio (for instance, λ>1.2).

For instance, it is assumed that the engine 11 is accelerated from a condition that the air-fuel ratio is feedback-controlled to a target air-fuel ratio with the basic fuel injection amount TP being 3 mg per crankshaft revolution and the feedback correction factor FAF is 0.8. Even if the basic fuel injection amount for the acceleration is calculated as 10 mg per crankshaft revolution, the actual amount of fuel injected results in 8 (=10×0.8) mg per crankshaft revolution which is 2 mg less than required (10 mg). Because this feedback correction amount FAF (0.8) was calculated before the engine acceleration, the appropriate amount of fuel reduction should be 0.6 (=3×(1−0.8)) mg per crankshaft revolution. Thus, the fuel injection amount is excessively reduced by the amount of 1.4 (=2.0−0.6) mg per crankshaft revolution, causing over-lean air-fuel ratio.

Figure 2:
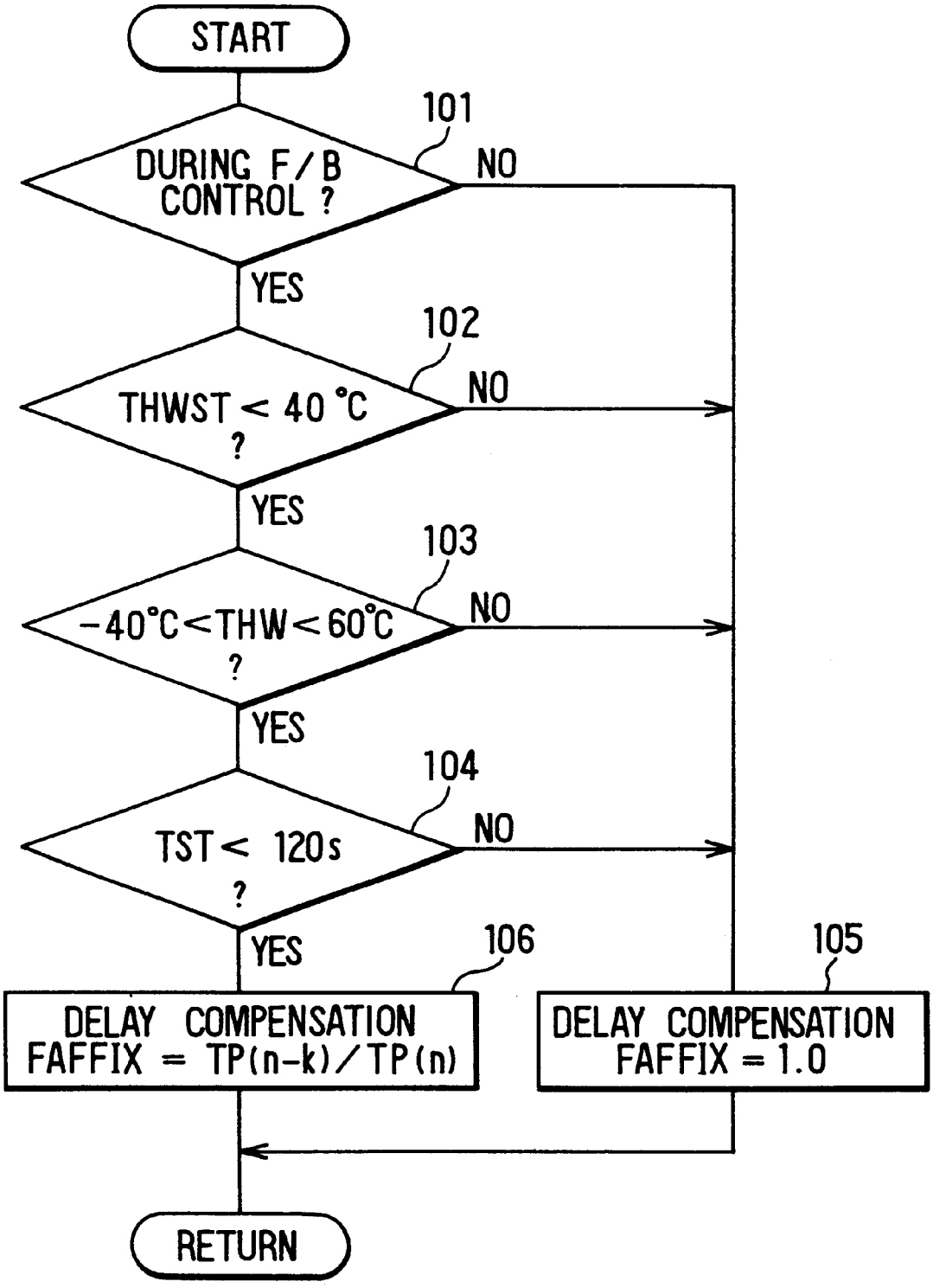
FIG. 2 is a flow diagram showing a delay compensation amount calculation program executed in a first embodiment of the present invention.

According to the first embodiment, on the contrary, the delay compensation amount FAFFIX is calculated by comparing the basic fuel injection amount (TP(n)) calculated presently and the basic fuel injection amount (TP(n−k)) calculated k-times before (step 106 in FIG. 2). The final feedback correction amount FAF is calculated by correcting the basic feedback correction amount FAFCAL with the delay compensation amount FAFFIX. As a result, the delay compensation amount FAFFIX is reduced immediately after time t1 as shown in FIG. 5B in response to an increase in the fuel injection amount TP(n) at time t1 in FIG. 5A, and hence the feedback correction amount FAF is responsively increased as shown in FIG. 5C. The delay in the feedback correction amount FAF relative to a change in the fuel injection amount TP(n) is reduced to a minimal.

Thus, even when the feedback control is continued upon engine acceleration during the engine warm-up period, the feedback correction amount FAF can follow the change in the fuel injection amount. The reduction of the fuel injection amount at the engine acceleration can be optimized to restrict the air-fuel ratio from being controlled to too fuel-lean air-fuel ratio.

Figure 6:
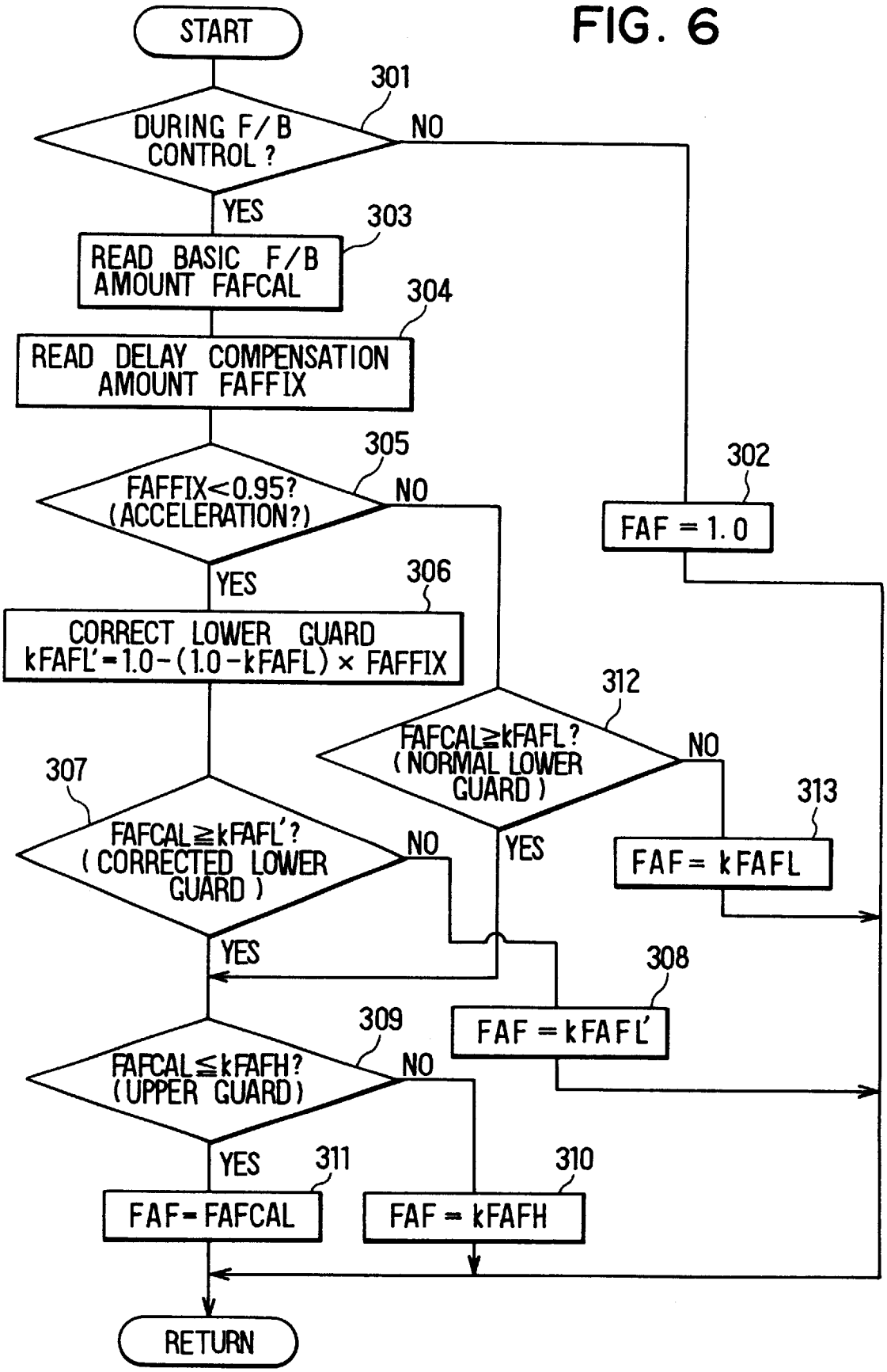
FIG. 6 is a flow diagram showing a feedback correction amount compensation program executed in a second embodiment of the present invention.

The air-fuel ratio feedback control system shown in FIG. 1 may be implemented as shown in FIG. 6 as a second embodiment in place of the program of the first embodiment shown in FIG. 3. In the second embodiment, the delay compensation amount FAFFIX is used to correct the lower guard value kFAFL which guards the basic feedback correction amount FAFCAL.

Specifically, steps 301 to 305 are executed in the same manner as steps 201 to 205 of the first embodiment (FIG. 3), respectively. If the check result at step 305 is YES indicating the engine acceleration, the lower guard value is calculated at step 306 as kFAFL' as follows. That is, the normal lower guard value kFAFL is corrected with the delay compensation amount FAFFIX.

$$KFAFL'=1.0-(1.0-kFAFL)\times FAFFIX$$

Then, it is checked at step 307 whether the basic feedback correction amount FAFCAL is equal to or larger than the corrected lower guard value kFAFL'. If the check result is NO, the feedback correction amount FAF is set to the corrected lower guard value kFAFL' at step 308.

If the check result at step 307 is YES, it is further checked at step 309 whether the basic feedback correction amount is equal to or smaller than the normal upper guard value kFAFH. If the check result is NO, the feedback correction amount FAF is set to the normal upper guard value kFAFH at step 310. If the check result is YES indicating that the basic feedback correction amount FAF is between the corrected lower guard value kFAFL' and the normal upper guard value kFAFH, the feedback correction amount FAF is set to the calculated basic feedback correction amount at step 311.

If the check result at step 305 is NO indicating no engine acceleration, on the other hand, it is further checked at step 312 whether the basic feedback correction amount FAFCAL is equal to or larger than the normal upper guard value kFAFL. If the check result is NO, the feedback correction amount FAF is set to the normal lower guard value kFAFL at step 313. If the check result at step 312 is YES, step 309 is executed so that the feedback correction amount FAF is set to either FAFCAL (step 311) or kFAFH (step 310).

Figure 7A:
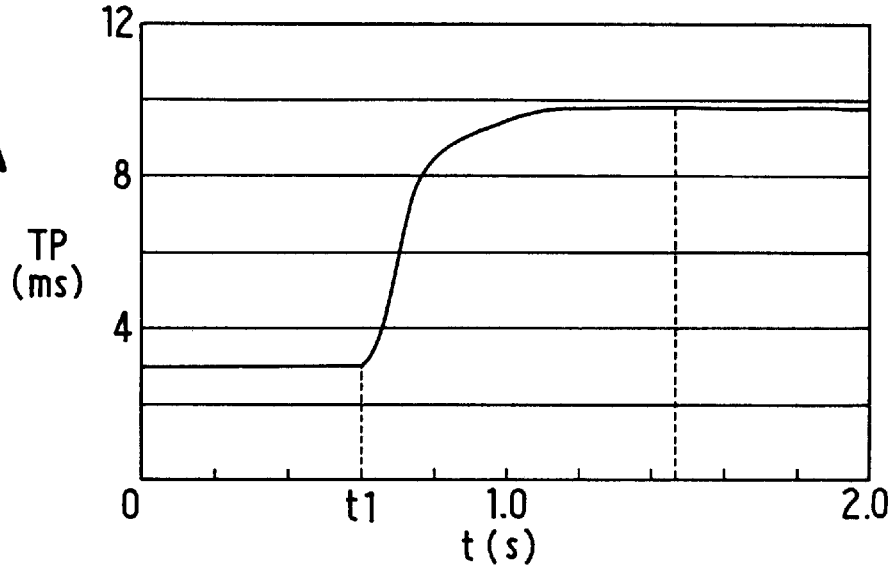
FIGS. 7A, 7B and 7C are timing diagrams showing an operation of the second embodiment shown in FIG. 6.
Figure 7B:
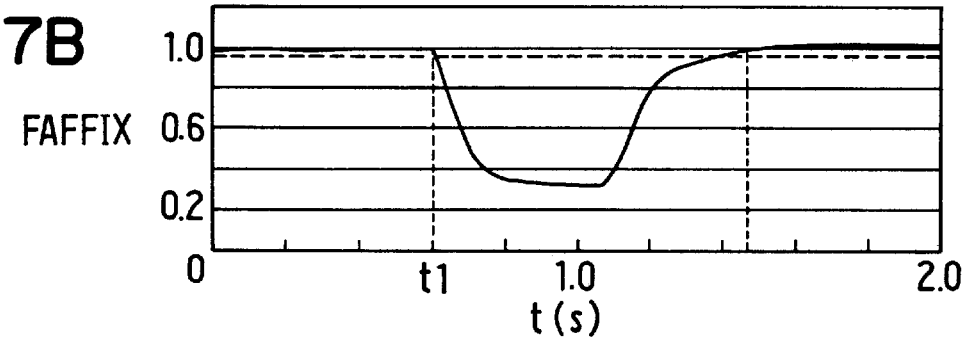
Figure 7C:
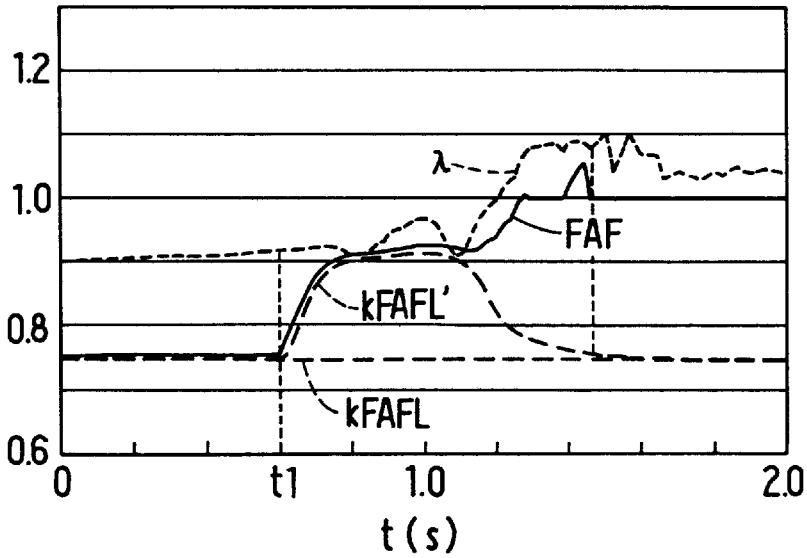

The operation of the second embodiment is shown in FIGS. 7A, 7B and 7C. It is assumed that the engine 11 is accelerated at time t1 to increase the fuel injection amount TP as shown in FIG. 7A under the engine-decelerated and fuel-rich condition during the engine warm-up period, that is, under the condition that the feedback correction amount FAF is limited to the normal lower guard value as shown in FIG. 7C. In this instance, the delay compensation amount FAFFIX changes immediately after time t1 as shown in FIG. 7B, and hence the lower guard value is corrected to the lower guard value kFAFL' which increases as shown in FIG. 7C. Thus, the feedback correction amount FAF and the resulting air-fuel ratio is changed responsively within a short period of time after time t1.

According to the second embodiment, the normal lower guard value kFAFL is corrected with the delay compensation amount FAFFIX to the lower guard value kFAFL'. As the delay compensation amount FAFFIX is reduced immediately in response to the increase in the basic fuel injection amount TP, the corrected lower guard value kFAFL' increases responsively so that the feedback correction amount FAF is limited to the increased lower guard value kFAFL'. Thus, the feedback correction amount FAF is allowed to rapidly follow the changes in the air-fuel ratio detected at the engine exhaust side. Therefore, even if the feedback control is continued at the time of engine acceleration during the engine warm-up period, the air-fuel ratio is controlled not to become too lean in fuel.

In the above embodiments, the delay compensation amount FAFFIX may be calculated from parameters other than the present and past fuel injection amounts TP(n) and TP(n−k). For instance, it may be calculated from engine load parameters such as the intake air amount GA, intake air pressure PM, or throttle opening angle TA, because the fuel injection amount TP is calculated from such engine load parameters. Further, the feedback correction amount FAF may be corrected with the delay compensation amount FAFFIX and the normal upper guard value kFAFH may be corrected to a new corrected upper guard value with the delay compensation amount FAFFIX in the second embodiment, when the engine is decelerated.

Further, the correction to the air-fuel ratio feedback control parameter such as the feedback amount FAF or guard value with the delay compensation amount FAFFIX may be effected not only at the time of the engine transient conditions during the engine warm-up period but also continuously during any engine transient condition period or engine warm-up period. Further, it may be effected during the whole period of the air-fuel ratio feedback control.

Still further, the correction to the basic feedback amount FAFCAL or the normal guard value kFAFL or kFAFH with the delay compensation amount FAFFIX may be started when the basic feedback amount changes beyond a predetermined range (that is, when the basic feedback amount changes in the increasing or decreasing direction by an amount in excess of a predetermined amount) and may be ended when the feedback control is stopped or the delay compensation amount is reduced to be less than a predetermined level (that is, the delay in the feedback correction amount becomes short).

The present invention should not be limited to the disclosed embodiments and modifications, but may be implemented in many other ways without departing from the spirit of the invention.

What is claimed is:

1. An air-fuel ratio feedback control system for engines comprising:

a fuel injector mounted on an engine for injecting fuel into the engine;

an air-fuel ratio sensor disposed in an exhaust side of the engine for detecting an air-fuel ratio of air-fuel mixture supplied into the engine; and a feedback control unit for feedback-controlling the amount of fuel injected from the fuel injector in response to the detected air-fuel ratio, wherein the control unit includes a feedback amount calculation part for calculating a basic feedback amount in response to the detected air-fuel ratio, a feedback guard calculation part for calculating a guard value which limits a feedback control to the guard value, and a delay compensation amount calculation part for calculating a delay compensation amount which compensates for a delay time from a change in the amount of fuel injected from the fuel injector to a detection of the air-fuel ratio corresponding to the change in the amount of the injected fuel, and wherein the control unit calculates a final feedback amount based on the basic feedback amount, the guard value and the delay compensation amount.

2. An air-fuel ratio feedback control system of claim 1, wherein the feedback control unit further includes a correction which corrects the basic feedback amount with the delay compensation amount.

3. An air-fuel ratio feedback control system of claim 1, wherein the feedback control unit further includes a correction part which corrects the guard value with the delay compensation amount.

4. An air-fuel ratio feedback control system of claim 1, wherein the delay compensation amount calculation part calculates the delay compensation amount from parameters related to present and past basic fuel injection amounts, the past basic fuel injection amount being calculated the delay time before the a calculation of the present basic fuel injection amount.

5. An air-fuel ratio feedback control system of claim 1, wherein the control unit calculates the final feedback amount using the delay compensation amount at least during an engine warm-up period.

6. An air-fuel ratio feedback control system of claim 1, wherein the control unit calculates the final feedback amount using the delay compensation amount at least during an engine transient operation period.

7. An air-fuel ratio feedback control system of claim 1, wherein the control unit calculates the final feedback amount using the delay compensation amount only upon an acceleration/deceleration of the engine during an engine warm-up period.

8. An air-fuel ratio feedback control system of claim 7, wherein the delay compensation amount calculation part calculates the delay compensation amount from a ratio between present and past basic fuel injection amounts, the past basic fuel injection amount being calculated a predetermined number of fuel injections before a present basic fuel injection.

9. An air-fuel ratio feedback control system of claim 8, wherein the acceleration/deceleration of the engine is determined from the delay compensation amount.

10. An air-fuel ratio feedback control system of claim 1, wherein the control unit calculates the final feedback amount using the delay compensation amount only upon an acceleration and deceleration of the engine occurring from the deceleration and acceleration of the engine, respectively, during an engine warm-up period.

11. An air-fuel ratio feedback control method for engines comprising:

effecting a feedback control of an air-fuel ratio of air-fuel mixture supplied to an engine at an intake side of the engine in response to an air-fuel ratio detected at an exhaust side of the engine during an engine warm-up period;

calculating a delay time compensation amount varying with a delay time between a supply of the air-fuel mixture and a detection of the air-fuel ratio of the supplied air-fuel mixture at the engine exhaust side;

detecting a predetermined engine transient operation condition; and correcting a feedback correction amount calculated from the detected air-fuel ratio with the calculated delay time compensation amount upon detection of the predetermined engine transient operation condition so that the air-fuel ratio of air-fuel mixture supplied at the intake side is feedback controlled with the corrected feedback correction amount.

12. An air-fuel ratio feedback control method of claim 11, wherein the predetermined engine transient operation condition is detected from present and past engine load conditions, the past engine load condition being existing the delay time before the present load condition.

13. An air-fuel ratio feedback control method of claim 12, wherein the delay time compensation amount is calculated from a ratio between the present and past engine load conditions.

* * * * *